US007220161B2

(12) United States Patent
Eriksson

(10) Patent No.: US 7,220,161 B2
(45) Date of Patent: May 22, 2007

(54) AUTOMATIC SHARPENING SYSTEM FOR ICE-SKATES

(76) Inventor: Magnus Eriksson, Bergsgatan 21B, 852 36 Sundsvall (SE)

( * ) Notice: Subject to any disclaimer, the term of this patent is extended or adjusted under 35 U.S.C. 154(b) by 0 days.

(21) Appl. No.: 11/161,795

(22) Filed: Aug. 17, 2005

(65) Prior Publication Data

US 2006/0040587 A1 Feb. 23, 2006

Related U.S. Application Data

(60) Provisional application No. 60/603,196, filed on Aug. 20, 2004.

(51) Int. Cl.
*B24B 51/00* (2006.01)

(52) U.S. Cl. ..... 451/5; 451/383; 451/8; 451/120; 451/124; 451/127; 451/150; 451/205

(58) Field of Classification Search ..... 451/5, 451/8, 45, 120, 124, 127, 150, 383, 205
See application file for complete search history.

(56) References Cited

U.S. PATENT DOCUMENTS

| | | | | | |
|---|---|---|---|---|---|
| 1,487,142 | A * | 3/1924 | Boker | 451/239 |
| 2,438,543 | A * | 3/1948 | Custin et al. | 451/153 |
| 2,563,018 | A * | 8/1951 | Fello | 451/241 |
| 3,040,481 | A * | 6/1962 | De Vlieg | 451/239 |
| 3,735,533 | A * | 5/1973 | Salberg | 451/152 |
| 3,827,185 | A * | 8/1974 | Smith | 451/72 |
| 3,844,394 | A * | 10/1974 | Hale et al. | 194/201 |
| 4,235,050 | A * | 11/1980 | Hannaford et al. | 451/151 |
| 4,241,544 | A * | 12/1980 | Hampton | 451/120 |
| 4,523,409 | A * | 6/1985 | De Fazio | 451/5 |
| 4,558,541 | A * | 12/1985 | Consay | 451/28 |
| 4,722,152 | A * | 2/1988 | Ek et al. | 451/5 |
| 4,817,339 | A * | 4/1989 | Weidmo et al. | 451/5 |
| 5,009,039 | A * | 4/1991 | Lager et al. | 451/11 |
| 5,283,983 | A * | 2/1994 | Lazarou | 451/488 |
| 5,287,657 | A * | 2/1994 | Tschida et al. | 451/72 |
| 5,353,329 | A * | 10/1994 | Hayashi | 455/556.1 |
| 5,591,069 | A * | 1/1997 | Wurthman | 451/241 |
| 5,601,473 | A * | 2/1997 | Strain et al. | 451/5 |
| 5,897,428 | A * | 4/1999 | Sakcriska | 451/202 |
| 6,116,989 | A * | 9/2000 | Balastik | 451/72 |
| 6,373,787 | B1 * | 4/2002 | Breimesser et al. | 368/10 |
| 6,535,791 | B1 * | 3/2003 | Wang | 700/235 |
| 6,543,686 | B1 * | 4/2003 | Ritter | 235/380 |
| 6,955,590 | B1 * | 10/2005 | Davis et al. | 451/160 |
| 2005/0130571 | A1 * | 6/2005 | Sunnen | 451/383 |

* cited by examiner

*Primary Examiner*—Lee D. Wilson
*Assistant Examiner*—Robert Scruggs
(74) *Attorney, Agent, or Firm*—Rolf Fasth; Fasth Law Offices

(57) ABSTRACT

A method is for using a skate-grinding device. The method provides an automatic sharpening system (10) that has grip members (14, 16) and a grinding wheel (28). A blade (18) of a skate (20) is inserted into a groove (19). The system is turned on. A motor (44) rotates the grinding wheel (28) and automatically moves the grinding wheel (28) within the groove to grind the blade (18). An electronic unit (86) measures a time the system (10) is used. A user of the system (10) is charged for the time measured by the electronic unit (86).

10 Claims, 3 Drawing Sheets

FIG. 4a-a

AUTOMATIC SHARPENING SYSTEM FOR ICE-SKATES

PRIOR APPLICATION

This application is a U.S. utility patent application claiming priority from U.S. provisional patent application 60/603,196, filed 20 Aug. 2004.

TECHNICAL FIELD

The present invention relates to an automatic sharpening system for ice-skates and other items.

BACKGROUND OF THE INVENTION

Ice skates, such as those used in ice-hockey and figure skating, require regular sharpening of the blades to create sharp edges against the ice to prevent slipping when the user skates on the ice. It is very important that the sharpening is performed correctly. Novice users cannot use conventional sharpening devices because they require skills to achieve a satisfactory sharpening of the blade edges. There is a need for an effective an automatic sharpening device that does not require skills to achieve satisfactory sharpening of ice-skate blades.

SUMMARY OF THE INVENTION

The device of the present invention provides a solution to the above-outlined problems. More particularly, the method is for using an automatic skate-grinding system. The method provides an automatic sharpening system that has grip members and a grinding wheel. A blade of a skate is inserted into a groove. A motor rotates the grinding wheel and automatically moves the grinding wheel within the groove to grind the blade. An electronic unit measures a time the system is used. A user of the system is charged for the time measured by the electronic unit. The system has automatic centering functions so that the grip members and sharpening device are always centered regardless of the thickness of the blade and the diameter of the grinding wheel. The grinding wheel provides a constant grinding pressure regardless of the shape of the blade.

BRIEF DESCRIPTION OF THE DRAWING

FIG. 4*a-a* is a detail view of a portion of FIG. 4*a;*

DETAILED DESCRIPTION

Figure 3:
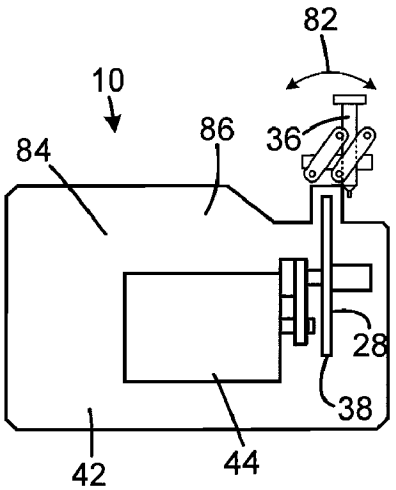
FIG. 3 is a cross-sectional side view of the sharpening device of the present invention.
Figure 1:
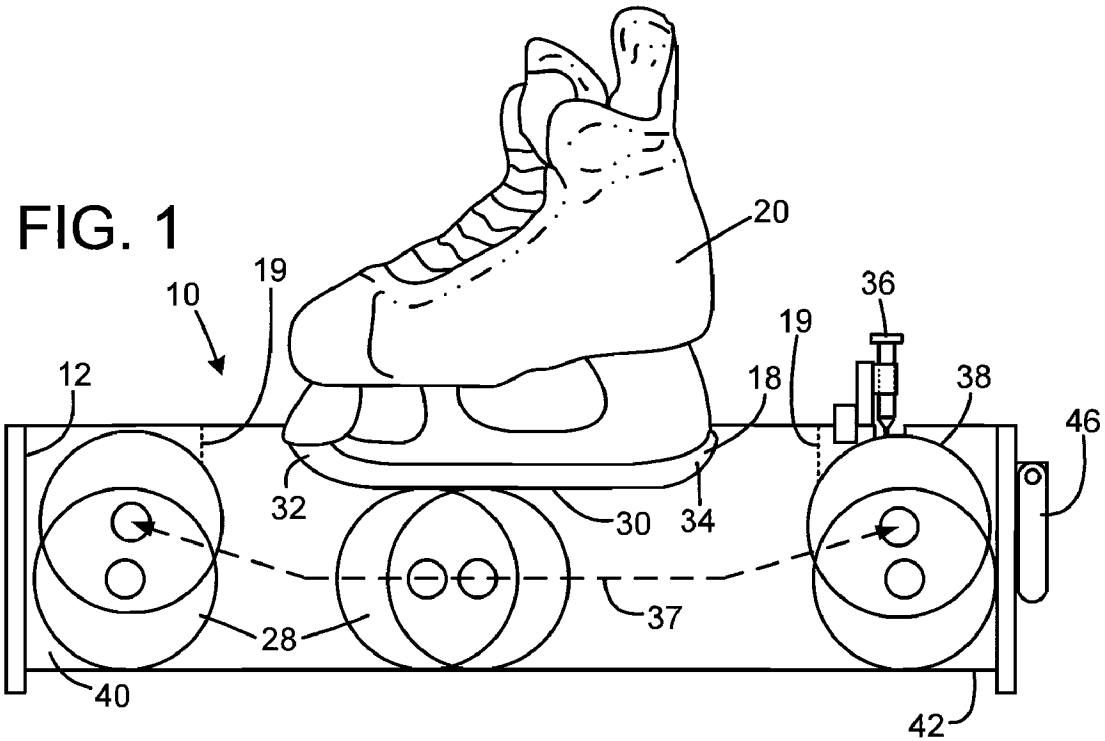
FIG. 1 is a schematic cross-sectional side view of the sharpening device of the present invention.
Figure 2:
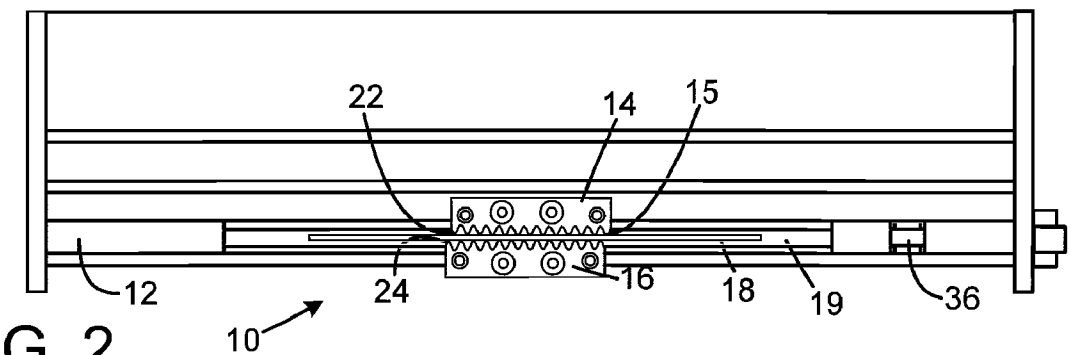
FIG. 2 is a top view of the sharpening device of the present invention.

With reference to FIGS. 1-3, an automatic sharpening system 10 of the present invention has a housing 12 with grip members 14, 16 to firmly hold a blade 18 of a skate 20 that has been inserted into to a groove 19 in the housing 12. The grip members 14, 16 have teeth 22, 24 to firmly hold the blade 18. As explained in detail below, the grip members have eccentric bearings so that the grip members are centrally positioned in the groove 19 regardless of the thickness of the blade 18. The housing 12 has a rotatable grinding wheel 28 that is movable along the blade 18 to grind an underside 30 of the blade. The grinding wheel 28 moves both along the blade but also upwardly at the rounded ends 32, 34 of the blade, as shown by the line 37. In this way the wheel may be moved from a front end 40 to a rear end 42 of the housing 12 and back. The housing 12 also has a grinding wheel sharpening device 36 that may be used to form the peripheral surface 38 of the grinding wheel 28. Preferably the peripheral surface 38 should have a convex shape so that the grinding wheel 28 forms the underside 30 of the blade 18 to a concave shape.

As best shown in FIG. 3, the housing has a motor 44 that not only rotates the grinding wheel 28 but also moves the grinding wheel 28 along the line 37, shown in FIG. 1. This is accomplished by a transmission mechanism that ensures that the grinding wheel rotates at a suitable rotational speed while moving the grinding wheel back and forth between the front end 40 and the back end 42 of the housing 12. The attachment of the grinding wheel 28 to the motor 44 is shifted from the main rotor axle of the motor so that the wheel 28 may be raised and lowered relative to the motor when the wheel 28 is grinding the rounded surfaces 32, 34, as explained in detail below. The housing also has a communication module 84, such as a GSM module, for being able to remotely control, such as from a mobile telephone, the operation of the device 10. The housing also an electronic unit 86 that controls and measures how much and how long the system 10 is used.

Figure 4A:
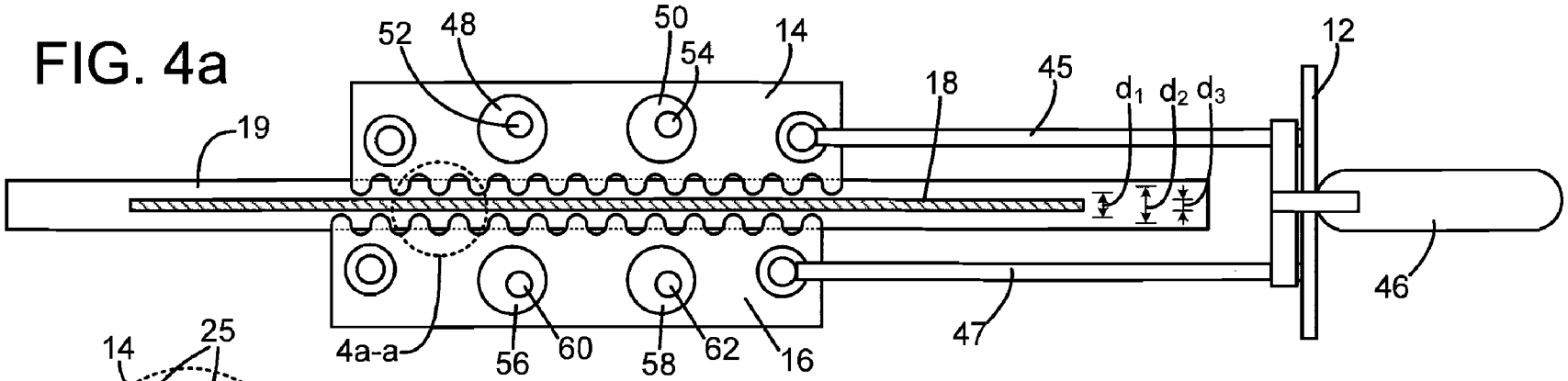
FIGS. 4*a* and 4*b* are cross-sectional top views of the centering mechanism of the present mechanism.
Figure 4B:
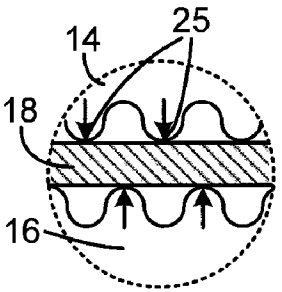
Figure 4B:
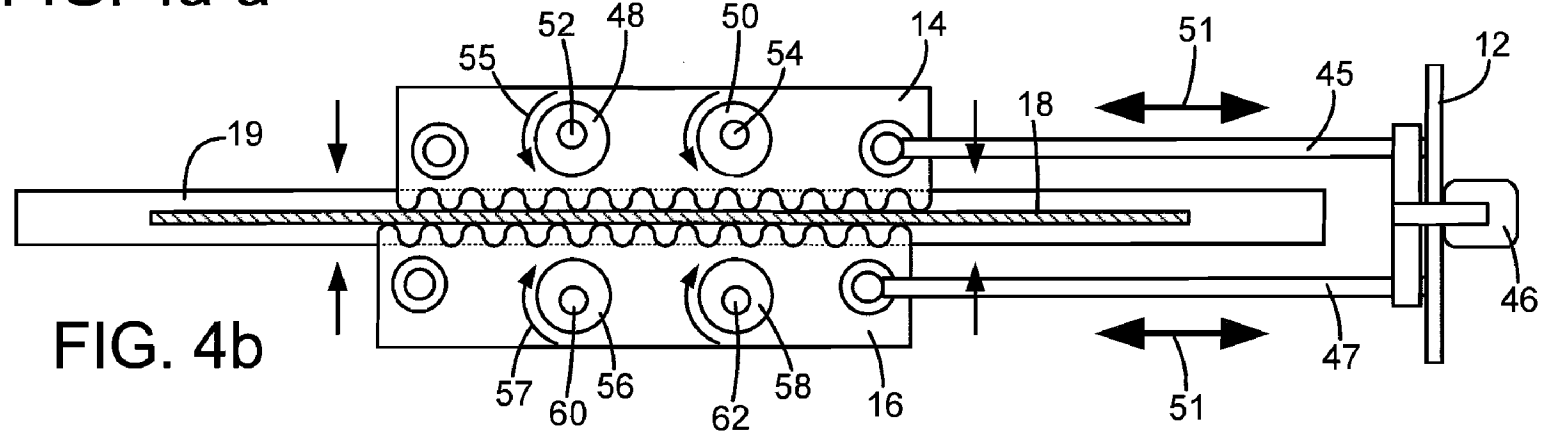

FIGS. 4*a* and 4*b* show detailed cross-sectional views of the housing 12 including the grip members 14, 16 that are connected via bars 45, 47 to a turnable adjustable handle 46. The grip members are adapted to hold skating blades 18 with different thickness. The grip members have teeth 22, 24 to increase the pressure points 25 on the blade surfaces. A gap 15 having a distance d1 is formed between the grip members 14. 16. The distance d1 may be increased to a distance d2 by turning the handle 46 in a first direction and the distance d1 may be reduced to a distance d3 by turning the handle in a second opposite direction. The distance d2 is greater than the distance d1 that is greater than the distance d3. The handle 46 may then be locked in place. An important feature of the present invention is that the grip members are centered in the gap 15 regardless of the thickness of the blade, i.e. regardless of the distance d. More particularly, the grip member 14 is attached by eccentrically mounted fasteners 48, 50 so that by pulling or pushing the grip member 14 relative to the handle 46, the fasteners rotate in a first direction 55 and the grip member 14 moves closer to the blade 18 or further away from the blade when the fasteners rotate about the eccentric rotors 52, 54 in a second direction, as shown by arrows 51. Similarly, the grip member the grip member 16 is attached by eccentrically mounted fasteners 56, 58 so that by pulling or pushing the grip member 16 relative to the handle 46, the fasteners rotate in the second direction 57 and the grip member 16 moves closer to the blade 18 or further away from the blade when the fasteners rotate about the eccentric rotors 60, 62 in the first direction. In this way, the grip-members 14, 16 are always symmetrically centered in the gap 15 and exert an even pressure on the blade 18 to firmly hold the blade during the grinding.

Figure 5A:
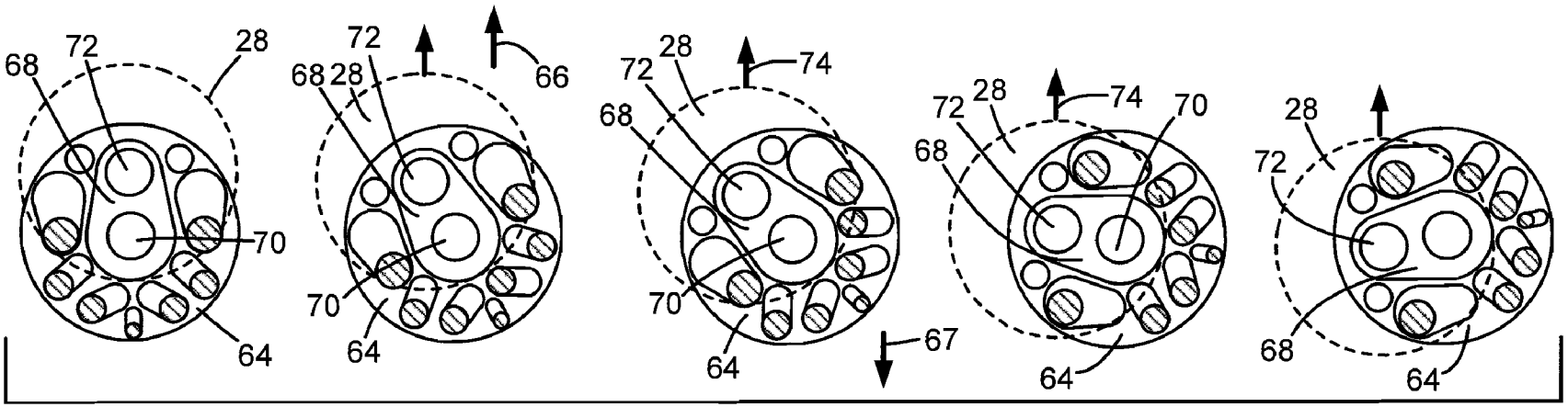
FIG. 5*a* is a schematic cross-sectional side view of the counter-weight device of the present invention.
Figure 5B:
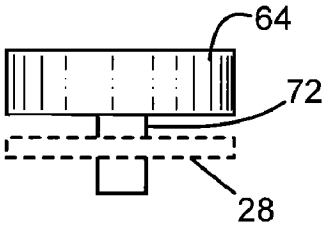
FIG. 5*b* is a top view of the counter-weight device of the present invention.
Figure 6A:
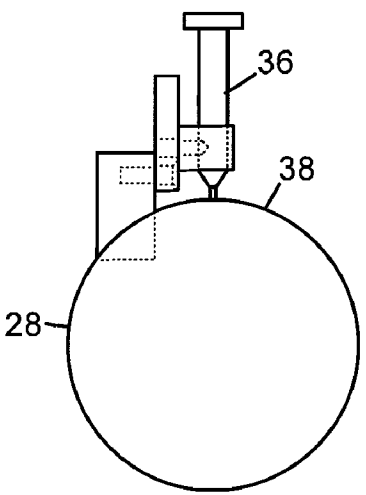
FIGS. 6*a*-6*d* are schematic cross-sectional side views of the adjustment mechanism of the present invention.
Figure 6B:
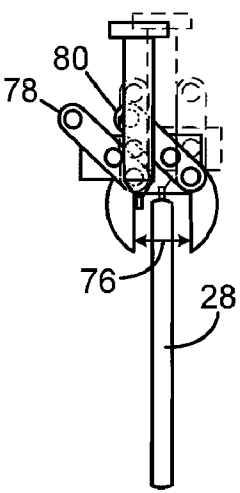
Figure 6C:
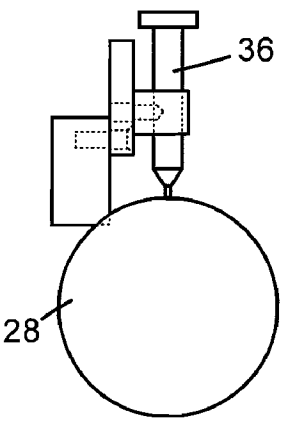
Figure 6D:
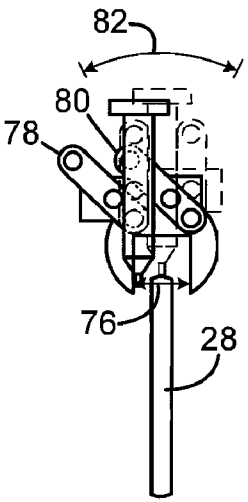

FIG. 5*a* shows counter-weight device 64 eccentrically mounted at an attachment point 70 on the grinding wheel 28 by a lever arm 68. FIG. 5*b* is a top-view of device 64 attached to the wheel 28. By turning the lever arm 68 about a rotational center 72 of the wheel 28, the center of gravity of the device 64 changes as the grinding wheel is moved in an upward direction 66 and a downward direction 67 to provide a linear grinding pressure 74 on the curved shape of the surfaces 32, 34 of the blade 18.

FIGS. 6*a*, 6*b*, 6*c* and 6*d* are detailed cross-sectional side views of the sharpening device 36 that creates a convex shape on the peripheral surface 38 on the grinding wheel 28. The sharpening device 36 may be used to sharpen grinding wheels 28 with different diameters while staying centered within a gap 76. The device 36 is mounted on lever arms 78, 80 that may be used to raise and lower the device 36. This is an important feature since the diameter of the grinding wheel is reduced as the grinding wheel is worn. In this way, the grinding position of the device 36 may be set to handle a wide range of diameters of the grinding wheels. The device 36 follows a curved path 82 as the device 36 is shifted sideways within the gap 76 to create the desired convex surface 38 on the grinding wheel 28. Another important feature is that the device 36 follows the path 82 regardless of the diameter of the grinding wheel 28. It is also possible to change the position of the lever arms 78, 80 so that the device 36 follows a path that is different from the shape of the path 82.

In operation, the user may insert the blade 18 into the groove 19. The handle 46 is turned and attached to firmly hold the blade 18 in place while the grip members 14, 16 are centered in the groove 19, regardless of the thickness of the blade, so that both grip members exert the same pressure on the blade. The system 10 is turned on and the motor 44 rotates the grinding wheel 28. The motor 44 also slowly moves the wheel 28 in a forward and back direction and follows the profile or shape of the underside of the blade 18 so that the wheel moves along the line 37. The grinding pressure 74 is constant despite the curved shape of the underside of the blade. The grinding pressure is provided by the counter-weight mechanism 64. When the grinding wheel 28 is positioned at the back end 42, the sharpening device 36 creates a convex shape on the peripheral surface 38 of the grinding wheel 28 regardless of the diameter size of the grinding wheel while staying centered in the gap 76. In this way, the system 10 is fully automatic and the only thing the user needs to do is to place the blade in the gap 19 and turn on the device. The user then pays a service provider of grinding service provided by the system 10. The user may pay per grinding session or per length of time the device is used. In one embodiment, an SMS (short message) may be send by the system 10 to a mobile phone to indicate the start of a grinding session. It is also possible to send a ring signal and then count the length of the telephone message. It is also possible to use a cash card that may be filled by calling a telephone number. In this way, the cost of the system 10 may be very low and the user may only pay for the time the user is using the system 10.

While the present invention has been described in accordance with preferred compositions and embodiments, it is to be understood that certain substitutions and alterations may be made thereto without departing from the spirit and scope of the following claims.

What is claimed is:

1. A method of using a skate grinding device, comprising:

provide an automatic sharpening system (10) having grip members (14, 16) and a grinding wheel (28);

inserting a blade (18) of a skate (20) into a groove (19);

automatically centering the grip members above the grinding wheel by turning a handle (46) so that the blade is aligned with the grinding wheel when adjusting a width of the groove with the handle;

connecting the handle (46) to a first bar (45) and a second bar (47), the first bar being connected to the grip member (14) and the second bar being connected to the grip member (16), the first bar being parallel to the second bar, the grip member (14) being attached by eccentrically mounted fasteners (48, 50), the grip member (16) being eccentrically mounted to fasteners (56, 58);

a motor (44) simultaneously and automatically rotating the grinding wheel (28) and moving the grinding wheel (28) within the groove along the blade from a first end (32) of the blade to a second end (34) of the blade to grind the blade (18);

an electronic unit (86) measuring a time the system (10) is used;

move the handle to a locked position to push the grip member (14) away from the handle to rotate the fasteners (48, 50) about eccentric rotors (52, 54) in a first rotational direction (55) and to push the grip member (16) away from the handle to simultaneously rotate the fasteners (56, 58) about eccentric rotors 60, 62) in a second rotational direction (57) to symmetrically narrow a gap (15) formed between the grip member (14) and the grip member (16), the first rotational direction (55) being opposite the second rotational direction (57);

moving the handle from the locked position to a released position to pull the grip member (14) towards the handle to rotate the fasteners (48, 50) about the eccentric rotors (52, 54) in the second rotational direction and to pull the grip member (16) towards the handle to simultaneously rotate the fasteners (56, 58) about the eccentric rotors (60, 62) in the first rotational direction to symmetrically widen the gap (15); and the system sending an activation signal to a remote communication device to indicate that the system is being used by a user.

2. The method according to the claim 1 wherein the method further comprises the grip members centering the blade within the groove.

3. The method according to the claim 1 wherein the method further comprises turning a handle to center the grip members and to exert a clamping pressure on the blade.

4. The method according to the claim 1 wherein the method further comprises a sharpening device (36) grinding a convex shape of a peripheral surface (38) of the grinding wheel (28).

5. The method according to the claim 1 wherein the method further comprises centering the sharpening device (36) within a gap (76).

6. The method according to the claim 4 wherein the method further comprises moving the sharpening device (36) along a peripheral path (82).

7. The method according to the claim 1 wherein the method further comprises rotating a counter-weight device (64) eccentrically mounted on the grinding wheel (28).

8. The method according to the claim 1 wherein the method further comprises the grinding wheel (28) automatically following a curved shape of rounded ends (32, 34) of the blade (18) while providing a constant grinding pressure.

9. The method according to the claim 1 wherein the method further comprises remotely controlling the system 10 with a mobile telephone.

10. The method according to the claim 1 wherein the method further comprises the handle (46) rotating eccentrically mounted fasteners (48, 50, 56, 58).

* * * * *